United States Patent [19]

Smith

[11] Patent Number: 4,723,883

[45] Date of Patent: Feb. 9, 1988

[54] STACKER BUNDLER SHUTTLE SYSTEM

[75] Inventor: Clark L. Smith, Belle Mead, N.J.

[73] Assignee: Stacker Machine Co., Inc., Paterson, N.J.

[21] Appl. No.: 764,242

[22] Filed: Aug. 9, 1985

[51] Int. Cl.[4] ..... B65G 57/11

[52] U.S. Cl. ..... 414/43; 414/907

[58] Field of Search ..... 271/181, 207, 216, 213; 414/43, 103, 104, 907; 198/463.3, 468.6

[56] References Cited

U.S. PATENT DOCUMENTS

| | | | |
|---|---|---|---|
| 1,756,920 | 4/1930 | Gollnick et al. | 271/213 |
| 3,164,270 | 1/1965 | Kinker | 414/43 X |
| 3,811,549 | 5/1974 | Preisig | 271/213 X |
| 4,049,259 | 9/1977 | Ventz | 414/112 X |
| 4,172,531 | 10/1979 | Müller | 271/181 X |
| 4,618,054 | 10/1986 | Muller | 198/468.6 X |

FOREIGN PATENT DOCUMENTS

| | | | |
|---|---|---|---|
| 769133 | 2/1957 | United Kingdom | 271/207 |

*Primary Examiner*—Frank E. Werner
*Assistant Examiner*—Janice Krizek
*Attorney, Agent, or Firm*—Ronald G. Goebel

[57] ABSTRACT

A stacker bundler apparatus for sheet material in signature form is provided. The apparatus includes a table having tracks on which a shuttle is mounted. The shuttle has a platform and is movable to a position under the signature. A pneumatic cylinder for raising the tracks is provided to engage the shuttle platform with the signature. The signature is the shuttle is transported to the forward end of the table where it is compressed by compression arms actuated by a lift cylinder and compression cylinder.

9 Claims, 9 Drawing Figures

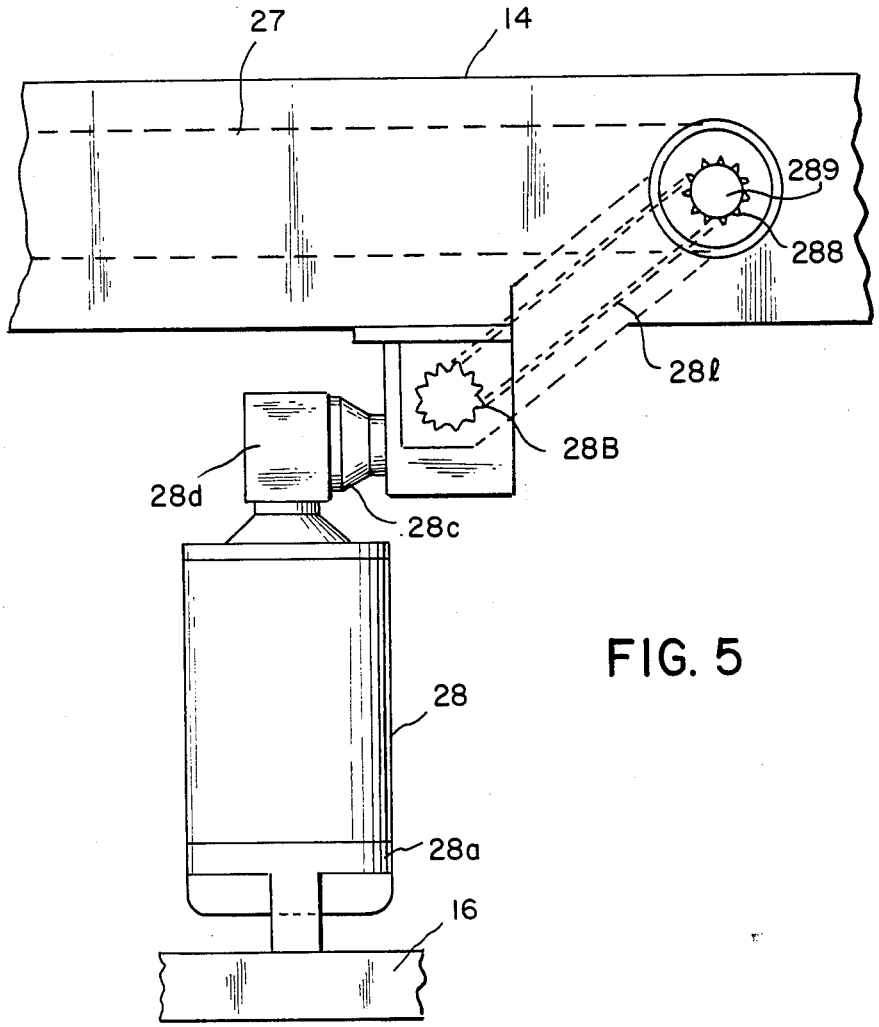
FIG. 5
FIG. 7
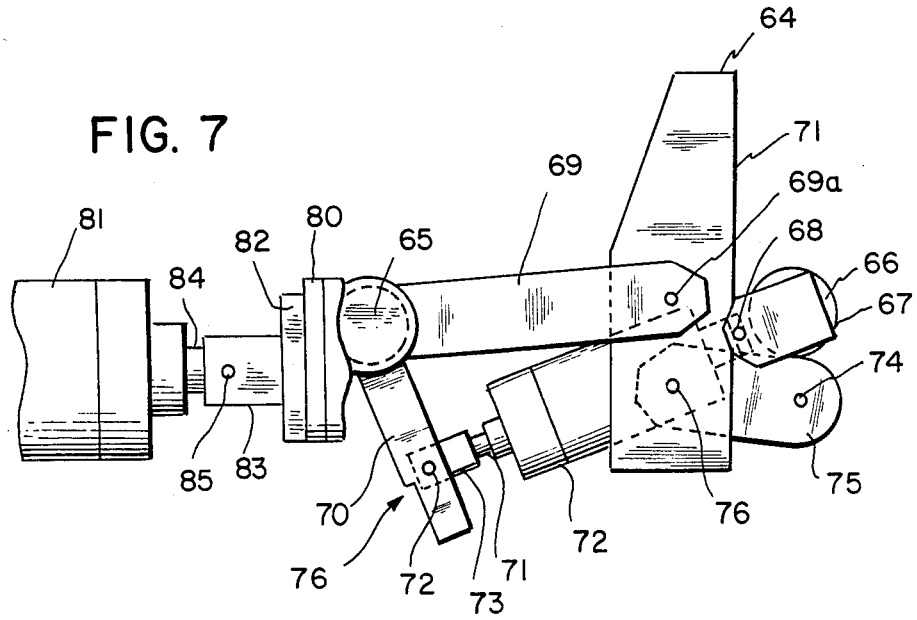

STACKER BUNDLER SHUTTLE SYSTEM

BACKGROUND OF THE INVENTION

This invention relates to an apparatus for transporting sheet material from a stacker to a bundler position.

In the past, paper material such as newspaper in signature form has been stacked or assembled on flat tables after printing operations from conveyors or stackers and then moved by hand to another portion of the table for compression and bundling. Such an operation has several disadvantages. Firstly, such hand movement of the stacked signature requires considerable strength and effort. Secondly, movement of the signature along the table tends to abrade and damage the lower edges of the signature in contact with the table.

The present invention, on the other hand, provides a stacker to bundler shuttle apparatus in the form of a table which carries a movable shuttle thereon for picking up and transporting a signature from the stacker to a position on the table for compression and bundling. Such apparatus renders insubstantial the effort required to move a signature and eliminates damage to the signature.

SUMMARY OF THE INVENTION

The apparatus of the invention includes a table having top horizontal supports which at its rearward end is connected with a stacker or conveyor which delivers or feeds sheets of paper in signature form to the table. A pair of endless belts are mounted on the rearward end of the table to carry a signature from the stacker to the table and onto raised guides located forwardly of the endless belts. A gate pivotably and slidably mounted above the table supports the signature in an upright position as it moves toward the raised guides. Horizontal tracks are mounted on each side of the table and are pivotably connected to each support at their forward ends. The two horizontal tracks extend just rearwardly of the endless belts. A shuttle having a side support on each side of the table and connected by a handle at the forward end is equipped with wheels which ride in the tracks. A platform is mounted on each side support capable of receiving and holding the signature. The shuttle is moved by hand along the tracks to a position underneath the signature. A pneumatically actuated lift cylinder acts to lift the tracks and hence the shuttle so that the platform of the shuttle engages the signature. The gate is then pivoted upwardly and moved rearwardly to separate the signature being shuttled from an oncoming signature arriving from the stacker. The shuttle carrying the signature is then manually pushed to the forward end of the table against a pair of stops. A pair of compression arms actuated by a pneumatic lift cylinder mounted beneath the table are raised to a point adjacent the signature. A pneumatically operated horizontal compression arm cylinder mounted between the top horizontal supports then compresses the compression arm into the signature against the stops. The signature is then bundled by conventional methods and removed from the shuttle. The shuttle tracks are then moved downwardly using the lift cylinder and the process is repeated for the next signature.

BRIEF DESCRIPTION OF THE DRAWINGS

FIG. 5 shows the drive means for the endless belts mounted on the rearward end of the apparatus of the invention;

FIG. 7 shows a sectional view of the bundler carriage assembly of the apparatus of the invention;

DETAILED DESCRIPTION OF THE PREFERRED EMBODIMENTS

Figure 1:
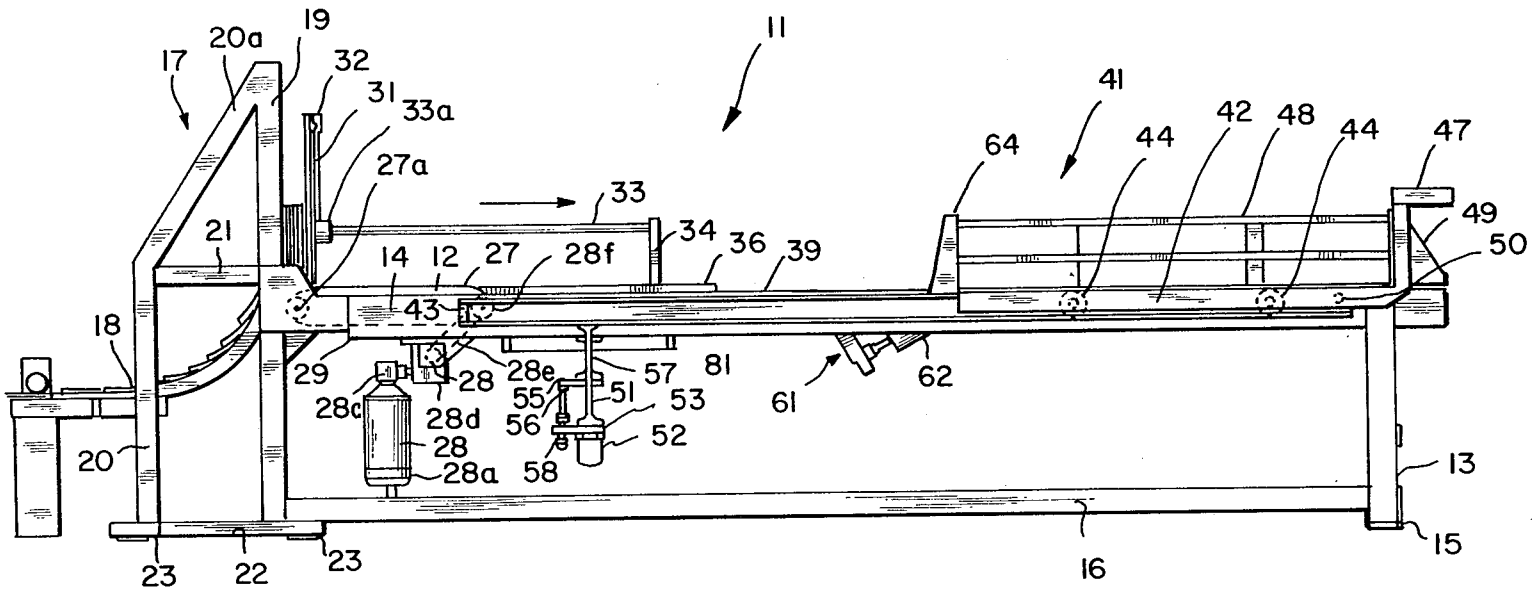
FIG. 1 is a side view of the apparatus of the invention showing the shuttle thereof in its forward position.
Figure 2:
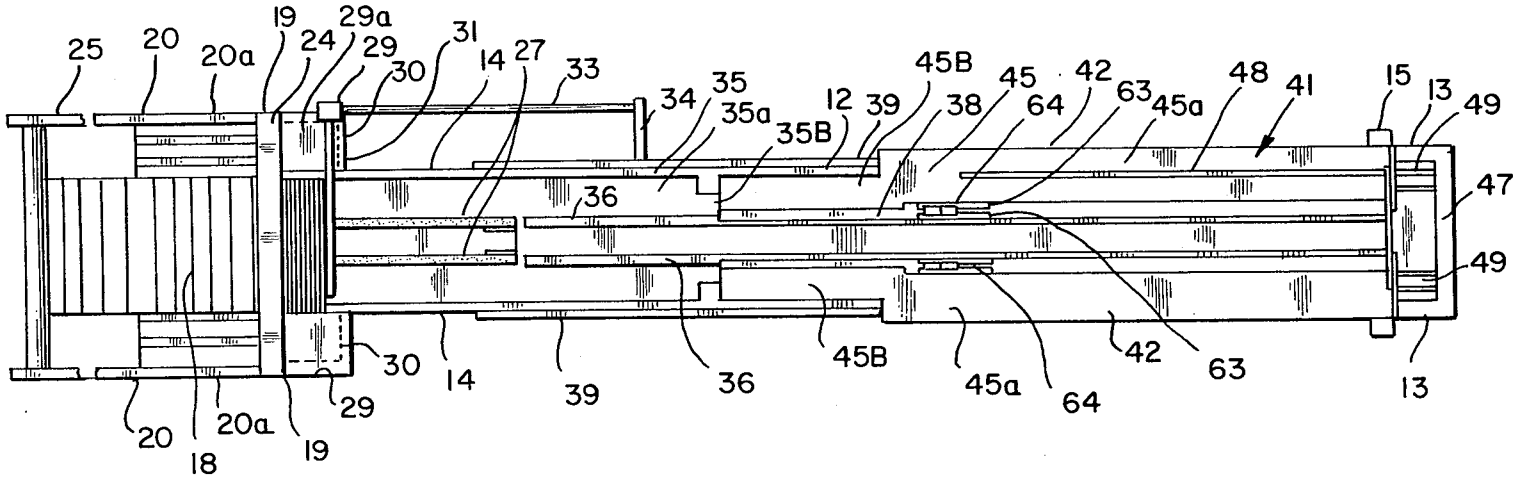
FIG. 2 is a top view of the apparatus as shown in FIG. 1.

Referring to the drawings and particularly FIGS. 1 and 2 there is shown generally a stacker bundler shuttle apparatus 11 according to the invention. The apparatus comprises a support structure 12 having forward legs 13, top horizontal supports 14 mounted at each end thereof to the top end of each leg, lower transverse support member 15 mounted across legs 13 and bottom horizontal support 16 whose forward (right) end is mounted on transverse support member 15 between legs 13.

Mounted at the rearward end of the support structure 12 is a conveyor or stacker shown generally by 17 which is well known in the art. The conveyor delivers or feeds sheets of paper 18 which are preferably in a folded or signature form to be assembled to form a newspaper, magazine, book or the like to the apparatus. The conveyor support structure consists of forward legs 19, rearward legs 20, top horizontal connector 21 which connects legs 19 and 20 at each side, bottom supports 22 which are mounted to and support the base of legs 19 and 20 and bottom cross pieces 23 which are connected between bottom supports 22. Top cross piece 24 connects the top of legs 19. The rearward end of bottom horizontal support 16 of the support structure 11 is connected at the center of the forward bottom cross piece 23. Signatures 18 are placed on the conveyor at station 25 and are carried forwardly and upwardly on the conveyor by belts (not shown). The conveyor has a table **29*a* supported by side supports 29 and end support 30. Top horizontal supports 14 of the shuttle apparatus are secured to end support 30 of the table. Referring to FIGS. 1 and 5, a DC motor 28 is mounted on bottom horizontal support member 16 by means of bracket 28*a*. The motor is connected to sprocket drive wheel 28*b* via double reduction worm gear box 28*c* encased by housing 28*d*. The drive wheel 28*b* drives chain 28*e* which is connected with driven sprocket wheel 28*f* mounted on shaft 28*g*. This shaft serves to drive belts 27 connected therewith and with idler roller 27*a***.

A gate 31 pivotably connected to gate housing 32 located forwardly of the conveyor 17 is used to support and separate signatures as they arrive on the table and pass across the apparatus on belts 27. The gate housing 32 is rotatably and slidably mounted on rod 33 which is secured to rod support bracket 34. The rod support bracket 34 is connected to the outer top horizontal support 14 of the apparatus. As a signature is moved forwardly from conveyor 17 to belts 27, the signature is supported uprightly by gate 31 which also moves forwardly (to the right) along rod 33 with the signature up to bracket 34.

Mounted between the horizontal top supports 14 is stationary table 35 having enlarged rearward section 35*a* and narrow forward section 35*b*. The table also has formed therein raised guides 36 which are substantially of the same height and width as the endless belts 27. Guides 38 continue from the raised guides forwardly to the forward end of the table. A pair of U-shaped shuttle table tracks 39 are mounted along the outside of each top horizontal support member 14 of the shuttle apparatus and extend from a point rearwardly of the endless belts 27 to the forward end. A shuttle shown generally by 41 is shown positioned at the forward end of the apparatus. The shuttle comprises a pair of side supports 42 each of which ride along a track 39. Each side support carries axled wheels 44 which allow the shuttle to be moved forwardly and rearwardly along tracks 39. Each side support is connected with handle 47 which extends across the table. Mounted atop each side support is platform member 45 consisting of a major forward section 45*a* and a rearward extension 45*b* on each side of track 39. As the shuttle is moved rearwardly the platform rides alongside raised guides 36 and belts 27 until the rearward extensions reach conveyor table 29*a*. A stop 43 is provided to prevent further movement. The shuttle is also equipped with a removable fence 48 located on one side thereof. A triangular stop 49 is mounted on each side of the forward end of the apparatus to prevent the shuttle from further movement and to act as a support for compression of the signature as will be discussed below.

The supporting tracks 39 on each side of the apparatus are pivotably connected to the top horizontal supports 14 at the forward end of the table by pivot pins 50 (shown dotted).

Figure 6:
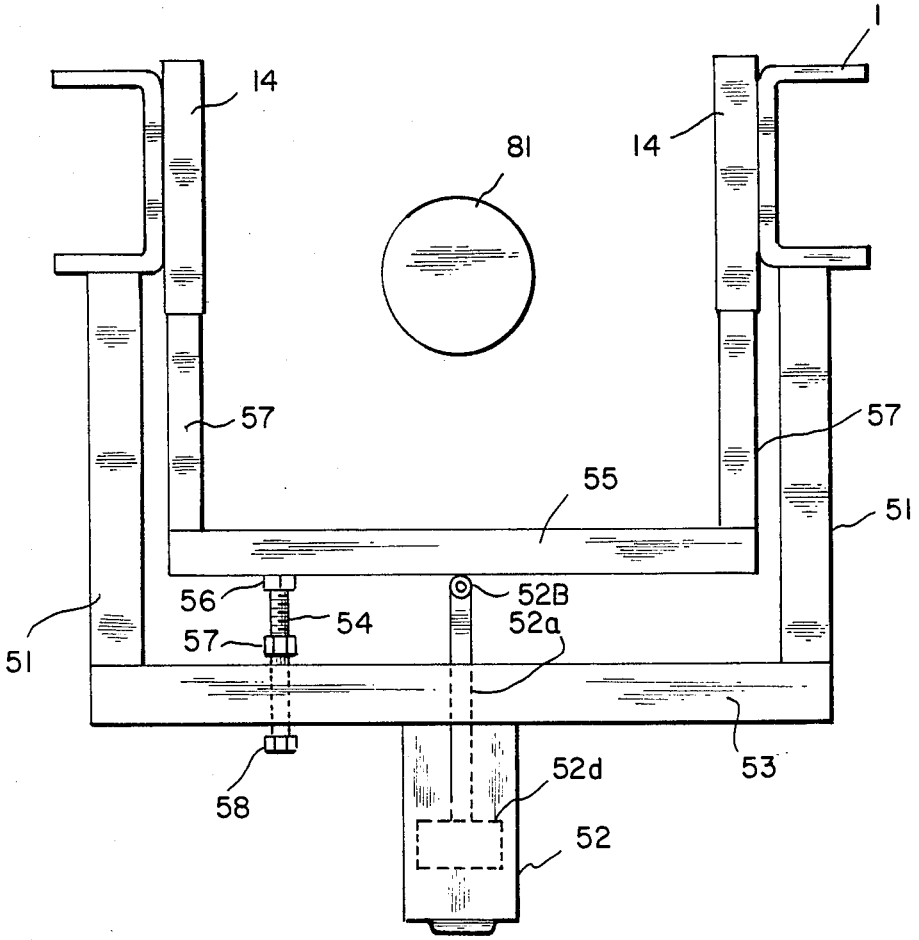
FIG. 6 shows an end view of the lift cylinder mechanism for raising the shuttle tracks of the apparatus.

Referring particularly now to FIGS. 1 and 6, the tracks 39 are supported at each of their rearward ends by the flat portion of rods 51 which are connected with pneumatic lift cylinder 52 having piston 52*d* and rod 52*b* through cross arm 53. Cross arm 53 contacts lift cylinder 52, the rod 52*b* of which extends through opening 52*a* in the arm and is pivotably connected to cross arm 55 at 52*c*. Rods 57 located inwardly of rods 51 support each top horizontal support 14. A threaded bolt 54 is inserted through an opening in arm 53 and into an opening in cross arm 55. Adjustment nut 56 abuts cross arm 55 and maintains rod 54 in position as shown. Adjustment nut 58 acts as a stop against the downward movement of rod 51 and adjustment nut 57 acts as a stop against the upward movement of rod 51. Thus, when the compressed air is introduced to the top of lift cylinder 52, the cylinder and the track 39 move upwardly about pivot point 50 a distance limited by adjustment nut 57. When copressed air is introduced to the bottom of lift cylinder 52 the track moves downwardly.

Figure 8:
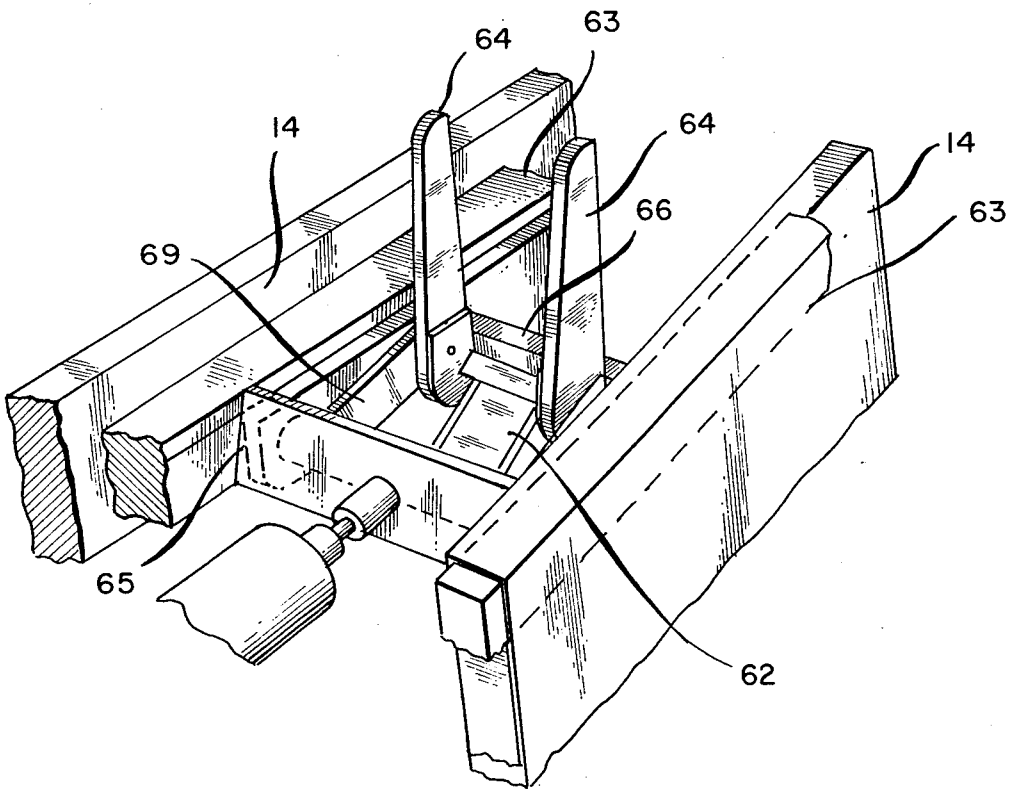
FIG. 8 shows a perspective view of the bundler carriage assembly of FIG. 7.

A bundling carriage assembly indicated generally by 61 is shown in FIGS. 1–4 and 7 and 8 which is mounted between the top horizontal support members 14 on tracks 63 (see FIG. 8). A compression arm lift cylinder 62 is employed in the assembly to raise and lower a pair of compression arms 64 which in FIGS. 1, 7 and 8 are shown in the up position. Referring particularly to FIGS. 7 and 8, there are two cylindrical rollers 65 and 66 mounted on tracks 63 to allow the bundler carriage to move forwardly and rearwardly. A connecting element 67 is axially and pivotably connected to cylinder 62 by pin 68. Rotatably mounted over roller 65 is an integrally formed arm assembly consisting of first compression arm 69 which at its forward end is pivotably connected to conpression arm 64 at about its midpoint by pivot pin 69*a* and an actuator arm 70. The actuator arm is pivotably connected to a connector 73 on piston rod 71 of cylinder 62 by pivot pin 72. Movement of the actuator arm 70 by the piston rod 71 also moves arm 69 formed integral therewith. Located below roller 66 on each side thereof is axle 74 (not shown in FIG. 8) which pivotably connects with second compression lift arms located on each side of the carriage assembly. The rearward end of each second compression lift arm is pivotably connected with compression arm 64 by pivot pin 76 below the pivot connection 69*a* of arm 69. Thus each arm can pivot about points 69*a* and 76 when cylinder 62 is actuated.

To achieve the down position the cylinder 62 is pneumatically actuated to extend piston rod 71 thereby moving actuator arm 70 in a clockwise direction which in turn moves arm 69 clockwise (downwardly). This movement also causes lift arm 64 to pivot about pins 69*a* and 76 in a counterclockwise direction until the edge 78 of each arm lies below top horizontal supports 14. A housing 80 is mounted over the sides of the carriage assembly having compression plate 82 centrally located thereon. A coupling 83 extends from the compression plate and is pivotably connected to the rod 84 of horizontal compression cylinder 81 by pivot pin 85. When cylinder 81 is pneumatically actuated, the rod 84 pushes the bundler carriage assembly forwardly to compress the compression arms 64 against the signature as will be described in more detail below.

Operation of the apparatus in general is as follows. Once a signature 18 is brought to the apparatus by conveyor 17 it is carried to the table 35 by belts 27. With gate 31 in the down position as shown in FIGS. 1 and 2, the signature is pushed forwardly by belts 27 to raised guides 36 and the gate moves along rod 33 with the signature up to bracket 34. Then the shuttle 41 is pushed rearwardly until the platform 45 lies under the assembled signature. Thereafter the tracks 39 are lifted upwardly by lift cylinder 52 allowing the platform 45 of the shuttle to engage the signature. The gate 31 is then pivoted upwardly, returned to a rearward position and pivoted downwardly again to separate the signature to be shuttled to the forward end of the apparatus from oncoming signatures. The compression cylinder is actuated to move the compression arms downwardly below top horizontal supports 14 if not already in that position. The shuttle is then pushed by hand to its forward end, that is to stops 49. Thereafter the compression cylinder 62 raises the compression arms 64 to a position rearwardly adjacent the signature and horizontal compression cylinder 81 moves the compression arms forwardly to compress the signature against the stops. The signature is then strapped using nylon bands, for example, and the compression due to the horizontal cylinder 81 is released and the strapped signature bundle is removed from the apparatus. The lift cylinder 52 is then lowered to place the tracks 39 in the down position and the process is repeated.

Figure 3:
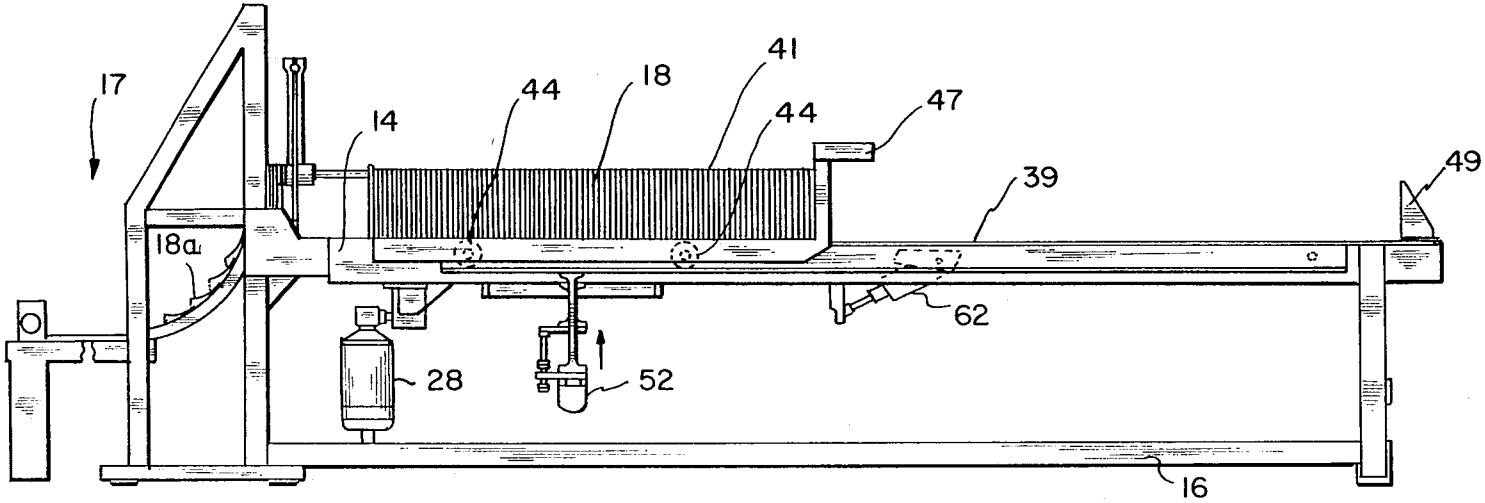
FIG. 3 is a side view of the apparatus of the invention showing the shuttle thereof moved to a rearward position under a signature.
Figure 4:
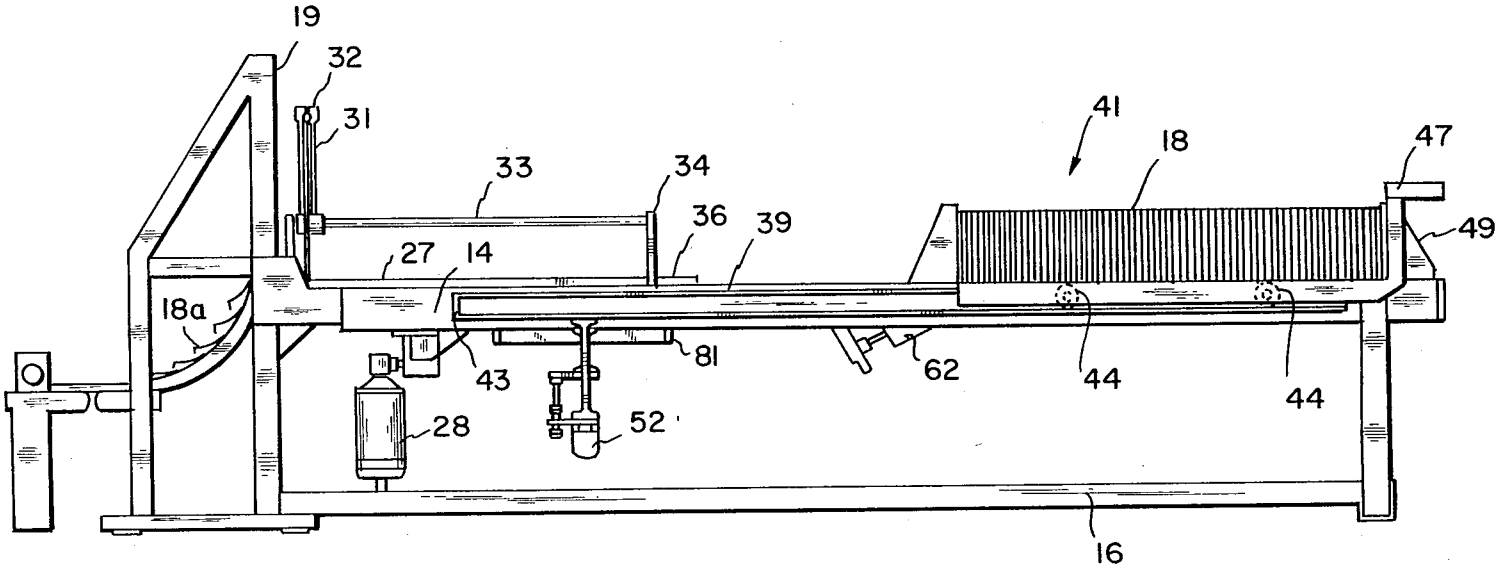
FIG. 4 is a side view of the apparatus of the invention showing the shuttle thereof bearing the signature at its forward position.
Figure 9:
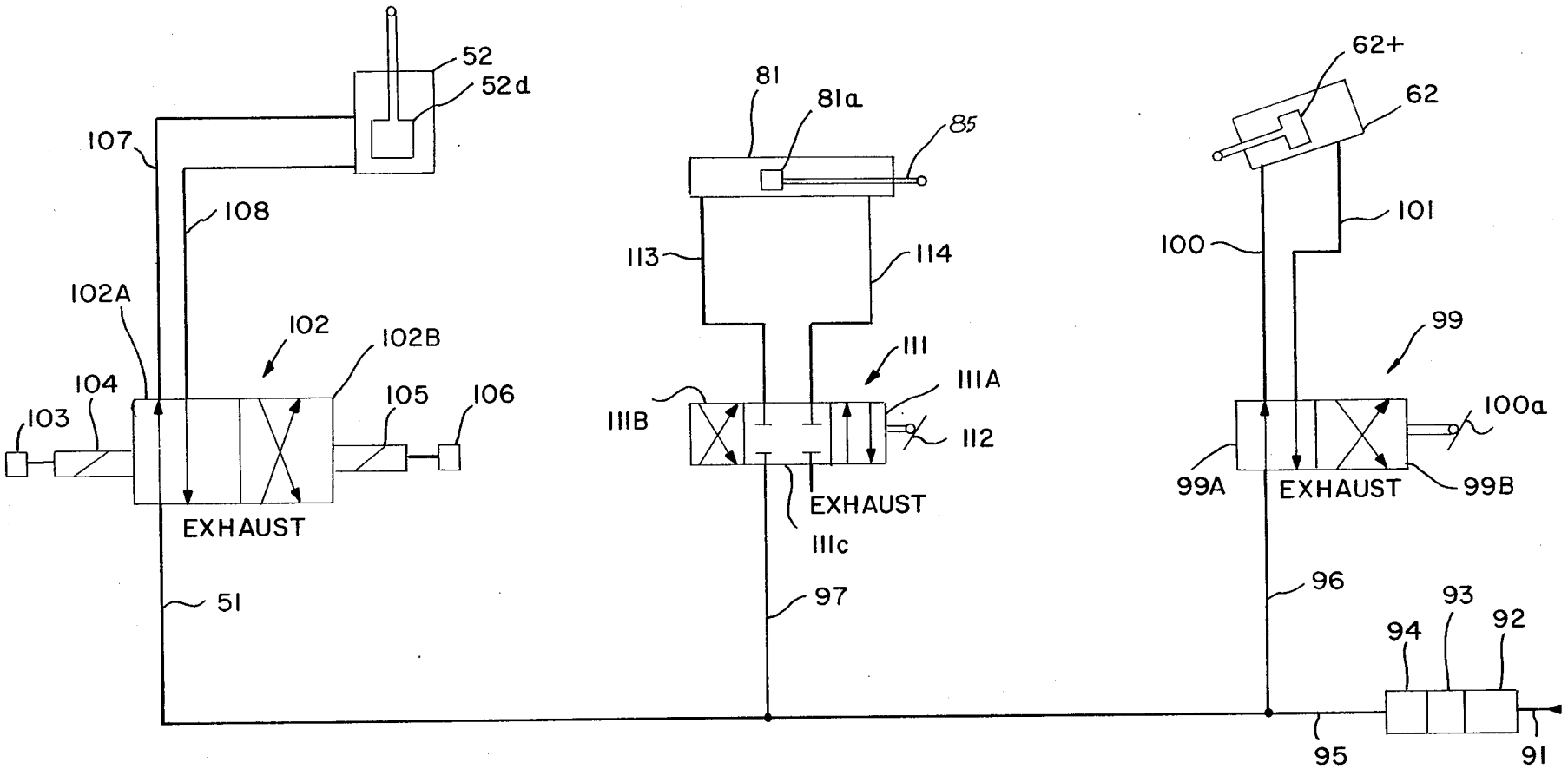
FIG. 9 shows a schematic of the operation of the pneumatic cylinders used in lifting the shuttle tracks and operating the bundler carriage assembly.

FIG. 9 shows a schematic of the pneumatic operation of lift cylinder 52, horizontal compression cylinder 81 and compression arm lift cylinder 62. The endless belts 27, as previously mentioned, are operated by DC motor 28. Referring now to FIGS. 1–4 and 9, pneumatic operation of the apparatus and aforementioned cylinders is as follows. In FIGS. 1 and 2, signature 18 from stacker 17 is deposited on endless belts 27 with gate 31 in the down position. In FIG. 3, the signature has been deposited on the raised guide and endless belts, gate 31 has been raised from the forward end of the signature 18, moved rearwardly and pivoted downwardly again separate a portion of oncoming signature 18*a*. The shuttle 41 has been moved rearwardly so that the platform 45 is underneath the signature. In FIG. 9, a source of compressed air is introduced into line 91 where it passes through filter 92, air pressure regulator 93, lubricator 94 into mainline 95 which branches off to lines 96, 97 and 98. Line 96 feeds compressed air to compression arms lift cylinder 62 which is controlled by slide valve 99. Slide valve 99 has two positions, 99A and 99B, which are interchanged by manual switch 100*a*. In the switch position 99A, compressed air from line 96 is introduced to the bottom of cylinder 62 via line 100 which causes piston 62*f* to move upwardly, thereby moving compression arms 64 to the upright position as in FIGS. 1 and 2. Compressed air is exhausted through valve 99 in line 101. To lower the compression arms as shown in FIG. 3, switch 100*a* changes the valve position to 99B and compressed air is introduced to the top of cylinder 62. This moves the piston 62*f* downwardly, thus lowering compression arms 64 as shown in FIG. 3. Air is exhausted through the valve 99 via line 100. Compressed air in branch line 98 is introduced to lift cylinder 52 via spool valve 102 as follows. Switch 103 is thrown which activates solenoid 104 and deactivates solenoid 105 to place spool valve 102 in position 102A. This causes compressed air to flow in line 107 to the top of cylinder 52, thus moving cylinder 52 upwardly against cross bar 53 and rods 51 to raise tracks 39. Exhaust for the cylinder is through line 108. The arrows in FIG. 3 show the track and cylinder movement. Next the operator pushes the shuttle table along its tracks to the forward stops 49. Switch 100*a* is activated to place slide valve 99 in the 99A position which raises piston 62*f* which in turn raises compression arms 64 adjacent to the signature as shown in FIG. 4. Slide valve 111 is changed from its neutral position 111C by switch 112 to position 111A. This causes compressed air to flow through line 113 into cylinder 81 to the left of piston 81*a*. Exhaust occurs through line 114. Rod 85 then moves forwardly, compressing the signature with the compressor arms 64 against the stops 49. The signature is then bundled using nylon straps for example, as well known in the art. Thereafter switch 112 is activated to change valve 111 to position 111B, thereby introducing compressed air to cylinder 81 to the right of piston 81*a* causing the piston to move rearwardly and release the compression of compressor arms 64 on the signature. Exhaust occurs in line 113. The valve is then switched to neutral position 111C. The tracks 39 are then lowered by energizing switch 106 which activates solenoid 105 and deactivates solenoid 104 and places spool valve 102 in position 102B. Compressed air then flows to the bottom of cylinder 52 via line 108 to move the cylinder and tracks 39 downwardly. Exhaust occurs in line 107. The shuttle is then in the position shown in FIG. 1. The apparatus is ready to repeat the operation.

I claim:

1. An apparatus for transporting vertically stacked paper sheet material in signature form from a first rearward section of a horizontal table to a second forward section of said table, said sheet material being transported by conveyor means to a stacker located at said rearward section of said table having means to supports a growing signature while it is being formed and prior to being transferred to a transport apparatus, said transport apparatus comprising:

(a) track means pivotably mounted on said table between said first and second sections;

(b) shuttle means mounted on said track means having a platform for lateral movement along said track means, said platform lying under said sheet material when said shuttle means is moved to said first section; and (c) means for supporting and pivotably raising said track means above said support means to deposit said sheet material on said platform whereby said sheet material can be transported to said section by said shuttle means.

2. The apparatus of claim 1 which further comprises means mounted on said table for compressing said sheet material.

3. The apparatus of claim 1 which further comprises conveyor means mounted on said table for moving sheet material.

4. An apparatus for transporting paper sheet material in signature form for bundling comprising:

(a) a table for receiving sheet material having a top horizontal support located on each side thereof;

(b) a conveyor mounted rearwardly on said table for moving said signature forwardly;

(c) raised guides mounted forwardly of said conveyor for supporting said signature;

(d) horizontal track means pivotably mounted on each of said top horizontal supports;

(e) a shuttle having a platform and side supports having wheels rotatably engaging said track means, said platform being lower on said table than said conveyor and raised guides when said track means are in an unpivoted position;

(f) means for lifting said track means mounted on said table; and (g) a bundling conveyor assembly mounted below said table having compression arms for engaging said signature, means for raising and lowering said compression arms and means for moving said compresion arms against said signature.

5. The apparatus of claim 4 which further comprises stop means located forwardly on said table.

6. The apparatus of claim 4 wherein a handle connects said side supports.

7. The apparatus of claim 4 wherein said shuttle further includes a movable fence.

8. The apparatus of claim 4 wherein said means for lifting said tracks is a pneumatically operated cylinder.

9. The apparatus of claim 4 wherein said means for raising and lowering said compression arms is a pneumatically operated cylinder.

* * * * *